United States Patent [19]

Rovelli

[11] 4,379,654

[45] Apr. 12, 1983

[54] DEVICE FOR KEEPING A LINING-LAYER IN CONTACT WITH THE WALLS OF A CIVIL-ENGINEERING WORKS

[75] Inventor: Giuseppe Rovelli, Turin, Italy

[73] Assignee: Industrie Pirelli S.p.A., Milan, Italy

[21] Appl. No.: 236,218

[22] Filed: Feb. 19, 1981

[30] Foreign Application Priority Data

Mar. 12, 1980 [IT] Italy ..... 20513 A/80

[51] Int. Cl.[3] ..... B65G 5/00; E21D 11/00

[52] U.S. Cl. ..... 405/53; 405/150

[58] Field of Search ..... 405/53, 133, 146, 148, 405/150, 151, 288, 289

[56] References Cited

U.S. PATENT DOCUMENTS 1,766,324 6/1930 Berner ..... 405/289 X 3,373,571 3/1968 Records ..... 405/150

3,417,538 12/1968 Dean ..... 405/151 X 4,239,416 12/1980 Borca et al. ..... 405/53

*Primary Examiner*—David H. Corbin

*Attorney, Agent, or Firm*—Stevens, Davis, Miller & Mosher

[57] ABSTRACT

This invention provides a device for maintaining a flexible, inextensible fluid impervious sheet which forms a lining for the walls of a cavity in the earth in contact with the walls.

The device has a plurality of frames comprising rods hinged one to the other in a cascade-connection, the end rods being provided with elastically deformable means (such as pressure pads) to distribute the contacting pressures between the lining and the walls, independently of any uneveness in the cavity wall.

9 Claims, 4 Drawing Figures

DEVICE FOR KEEPING A LINING-LAYER IN CONTACT WITH THE WALLS OF A CIVIL-ENGINEERING WORKS

This invention relates to a device for keeping a sheet of fluid impervious material in contact with the inner walls of an excavation in the earth and, in particular, it relates to a device for keeping a liner against the walls of an excavation in the earth such as a tunnel or a basin for storing a fluid such as a water reservoir or the like.

By "lining-sheet" or "liner" as used herein is meant a flexible, inextensible and fluid-tight casing which is impervious to liquids, for preventing any contamination of the contents of a storage tank or reservoir or penetration of the walls of a tunnel by fluids from the surrounding soil through the walls of the excavation.

The lining-sheet must also be impervious to fluid stored inside an excavation to avoid loss of fluid and to avoid pollution of the surroundings.

The device for holding the lining sheet in contact with the walls of the excavation must not be too large and cumbersome for handling or so large that it occupies an excessive amount of space in the excavation, and preferably, the device should be suspendable by spaced supports without substantial sagging so it does not sag between its supports against the wall.

It is also desirable for the liner to exert its own pressure against the walls of the excavation, at several points and in a uniform manner independently of the roughness or holes in the walls of the excavation even when the space inside the excavation is evacuated to remove fluid present therein.

An object of the present invention is to provide a device for maintaining a flexible lining pressed against the walls of an excavation in the earth which is devoid of the foregoing disadvantages. Another object of the invention is to provide a support structure for a flexible, substantially inextensible, fluid impervious liner for an excavation such as a tunnel, water reservoir or the like which has dimensions which adapt it for installation without serious handling problems and without reducing the volume of the excavation significantly. Still another object of the invention is to provide a supporting structure for maintaining a liner against the wall of an excavation which is easily installed and removed and which reliably presses the liner against the wall.

Other objects will become apparent from the following description with reference to the accompanying drawing wherein FIG. 1 illustrates in cross-section a tunnel provided with a liner for the tunnel walls supported by one embodiment of supporting structure for the liner provided by the invention;

The foregoing objects and others are accomplished in accordance with the invention, generally speaking, by providing a device for maintaining a sheet-like fluid impervious liner for an excavation in the earth against the walls of the excavation which device has a plurality of spaced frames disposed in planes which are substantially perpendicular to the larger dimension of the excavation. Each of the frames comprises a double series of rods, the rods of each series being hinged together by a cascade connection. The first rods of each series are hinged to each other at one end and the last rods of the series have elastically deformable members hinged to them. There is at least one middle rod hinged to the next preceding rod of the series at a point which is intermediate of its length and to the rod that follows in correspondence of its end, and means for drawing apart the double series of rods.

Stated in another way, in its broader aspects the device for maintaining a lining in contact with the walls of an excavation contemplated by the invention comprises a plurality of frames spaced one from the other on each wall to be lined, and disposed in planes substantially perpendicular to the larger dimension of the excavation, each of the frames being formed by a series of rods, the rods of each series being hinged one to the other by a cascade-connection, wherein the first rods of each series are hinged one to the other at one of their extremities, the last rods have hinged at their extremities, elastically deformable elements and the intermediate rods, at least one in number, being connected by a hinge to the extremity of the preceding rod at a point intermediate of their length and to the rods that follow in correspondence of their extremities, and means for drawing apart the double series of rods.

"Walls" as used herein include all the surfaces of an excavation unless the wall is more particularly identified and include, for example, lateral walls, ceilings, floors, and the like.

Figure 1:
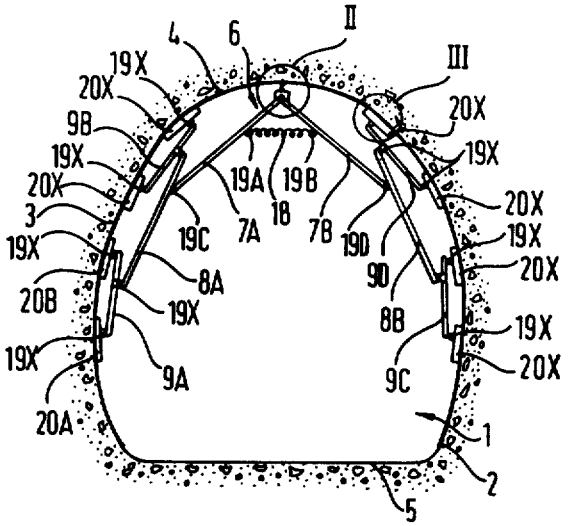

In FIG. 1, a tunnel is shown in cross-section lined with a flexible sheet as one form of the "excavation" contemplated. The flexible sheet which is substantially inextensible and fluid-tight and, in particular, is impervious to liquids, such as, for example, a rubberized fabric.

Lining 2, is maintained in contact with the lateral walls 3 and the ceiling 4 of tunnel 1, by means of a device according to the present invention, comprising a plurality of frames 6 spaced apart (only one is visible in the Figure) and disposed in planes substantially perpendicular to the greater dimension of tunnel 1.

Frames 6, are connected by conventional means to the ceiling 4 (as shall be described in the description of FIG. 2), or they can stay suspended under the pressure exerted by the frames 6 upon the walls of tunnel 1 (this solution being practical in particular, for cavities having reduced overall transverse dimensions).

Each frame 6, comprises a double series of rigid metallic rods hinged together and means for drawing apart the double series of rods, to press at least some of the rods against the walls of tunnel 1.

In the particular embodiment of the frame 6 having a double series of rods represented in FIG. 1, frame 6 comprises three types of rods such as push-rods 7, distributing rods 8 and pressure rods 9.

In other embodiments of the invention (not shown in the Figures), the rods can be variable in number, depending upon the transverse dimensions of the excavation, of the actual weight of the liner and the distance between two adjacent frames 6.

Each one of these rods is provided with three hinges, one on each extremity and one in an intermediate position, and preferably, in an a-symmetrical position with respect to the bary-center of each rod.

Figure 2:
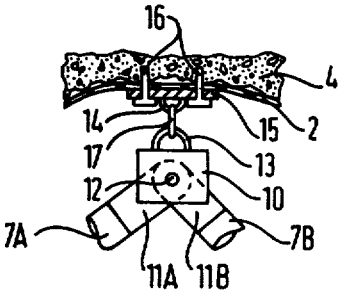
FIG. 2 is an enlarged view of the structure within circle II of FIG. 1.

In particular, the two push-rods 7 are hinged to one another at one extremity, disposed in correspondence of the means through which each frame 6 is connected to the ceiling 4 (see FIG. 2).

The connecting means comprise a C-shaped member 10 (seen laterally in FIG. 2), into which are inserted between the facing sides of C-shaped member 10, the extremities 11 of the two rods 7.

Extremities 11, whose outlines, inserted in the C-shaped member 10 are shown with a broken-line in the Figure, are provided with holes.

The two holes present on extremities 11 are aligned with two holes on the facing sides of C-shaped element 10 and a pin 12 is inserted in the four aligned holes on which reciprocal rotation occurs between two rods 7 and the C-shaped element 10.

C-shaped element 10 is suspended from ceiling 4 by means of two bail-rings 13 and 14, fixed respectively one to C-shaped element 10, and the other to a slab 15 fixed to ceiling 4 through appropriate bolts or pins 16.

Two bail-rings 13 and 14, are connected one to the other, by a ring 17 which can be opened along one side.

Rods 7, are further provided with means for drawing apart the double series of rods of the frames 6, and in particular, for pressing at least some of the rods of the frame 6 against the walls of the cavity 1.

The pressing means are, in the particular embodiment represented in FIG. 1, one or more springs 18 connected to each rod 7 by means of a hinge 19.

The pressing means can be, in an alternative embodiment (not shown in the Figures), a strut having a variable length, constituted by two elements co-axial to one another and connected by means of a screw-thread, for varying, by reciprocal rotation and translation, the total length of the strut.

Hinge 19, can be any conventional type, and a hinge-connection particularly suited for the purpose, will be described further on in this description.

Rods 7 are connected, at their ends, opposite to ends 11, to the distribution-rod 8, by means of hinge 19, similar to the previously mentioned hinge.

The hinges, between rods 7 and rods 8, and between rods 8 and rods 9, are all of the same type and are indicated with the numeral 19.

Moreover, the connection of the end of each rod, is effected to the successive rod at a point intermediate the ends of the successive rod, and preferably, at an asymmetrical position with respect to the bary-center of the successive rod.

Preferably, the connection is effected at a point situated at a greater height with respect to the floor 5 of the cavity 1, than the height of the bary-center of the rod.

By way of example, the connection between the push-rod 7 and the distribution-rod 8, takes place through a hinge placed in a higher position with respect to the bary-center of the rod 8, still with respect to the floor 5 of the cavity of tunnel 1.

Elastically deformable members are connected by means of a hinge 19 to the end of pressure rods 9. Pressure pads 20 adhering to the surface of the wall of tunnel 1 are examples of the elastically deformable members.

Since pressure-pads 20 are elastically deformable, they can conform to the shape of the wall and any irregularity in the surface.

Figure 3:
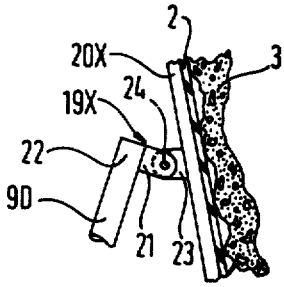
FIG. 3 is an enlarged view of the structure within circle III of FIG. 1.

Pressure-pads 20 are connected by means of a hinge 19 (see FIG. 3) that comprises two eyelets 21 (only one of these is visible) welded to the end 22 of pressure-rod 9.

Between the two eyelets, there is inserted a perforated slab 23, which is connected in cantilever fashion to the pressure-pad 20.

The holes of eyelets 21 are aligned with the hole present in the perforated slab 23 and a pin 24 is inserted in the resulting hole for reciprocal rotation between pressure-pad 20 and the end 22 of pressure-rod 9.

Preferably, the hinge is placed, with respect to the bary-center of the pressure-pad 20, in a higher position with regard to the floor 5 of cavity 1.

The bary-center, as occurs normally in elongate bodies having uniform structures, is placed at about one-half of the body.

This is true both for the pressure-pad 20, as well as for the rods 7, 8 and 9. This type of hinge just described, permits rotation only in the plane of the frames themselves between the various rods it comprises and between one rod 9 and one pressure-pad 20, so as to impede any relative rotation in planes that differ from the plane containing the frame 6.

Figure 4:
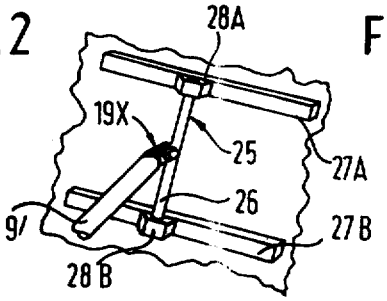
FIG. 4 is a perspective view of a second embodiment of the liner support provided by the invention.

In FIG. 4 is shown a detail of an alternate embodiment of a device according to the present invention. The detail illustrates the contact between the deformable elastomeric elements and the walls of the excavation.

In the particular embodiment represented in FIG. 4, at each end of the pressure-rod 9', there is connected by a hinge 19 an elastically deformable H-shaped structure 25 which is an elastically deformable member.

The elastically deformable member 25 comprises a transverse element 26 to which is connected the pressure-rod 9'.

Transverse element 26 lies in the same plane as the pressure-rod 9'.

Transverse element 26 is rigid for better distributing the pressures exerted by pressure-rods 9' on two elastically deformable tubes 27 connected, one at each end, to transverse element 26.

This connection is effected by inserting each end of the transverse element 26, into a seat present in a block 28 that is permanently fixed to each of elastically deformable tubes 27.

Elastically deformable tubes 27 are disposed perpendicularly to the plane containing both the pressure-rod 9' as well as the transverse element 26 and, as a consequence, are substantially parallel to the larger dimension of the excavation, to be able to maintain the lining 2' in contact with the walls of the excavation substantially along lines which are parallel to the larger dimension of the excavation.

This alternative embodiment of the device of the present invention which exerts pressure on the lining against the walls of the excavation along lines which are substantially parallel to the axis of the excavation has the advantage of permitting reduction of the number of frames necessary for maintaining the lining in contact with the walls.

The functioning of each frame will be described with reference to FIG. 1.

First of all, the lining-layer is disposed in contact with the walls of the tunnel and is kept in position for the short period necessary for mounting the various frames 6.

This is accomplished, for example, by forcing the lining-layer into contact with the walls by introducing pressurized-air into the casing constituting the lining; or else, with scaffoldings, which will be dismantled once the frames 6 have been installed.

Following this, each frame 6 is lifted to the top 4 of the cavity by conventional means.

Then, by ring 17, each frame 6 is connected to a slab 15 that was previously fixed to ceiling 4.

Once the frame 6 is suspended, spring 18 which was previously compressed, can be released.

Spring 18 starts pushing apart the two rods 7, which, by moving the two distribution-rods, press the various pressure-rods 9 closer to the walls, until they bring the pressure-pads 20 into contact with the liner forming the lining of the cavity walls.

When the pressure-pads 20 are almost in contact with the walls, a check can be made to see that the pressure-pads are properly in place and will not contact the lining such as along one edge.

At this point, spring 18 can be completely released so that it will press pressure-pads 20 firmly against the lining and push it against the cavity wall.

The pressure-pads 20, being elastically deformable and acting against only short portions of the walls can exert a pressure even against irregularities present on the surface of the walls.

Only with the device provided by the invention can the objects of the invention be achieved.

The plurality of spaced frames placed in planes which are substantially perpendicular to the axis of the excavation, maintain the lining in contact with the walls, even if the walls are not perfectly smooth.

The pressure-pads and the elastically deformable structures can become deformed to conform the liner to the irregularities and always maintain the lining in contact with the walls.

The pressure-pads and elastically deformable structures can adapt themselves to any non-uniform surface both, because pressure is applied only over short surfaces and the pads deform elastically.

Furthermore, because of the positioning of the various hinges of one rod and the next, in an asymmetrical position with respect to the bary-center of the successive rods, the frame, even when not contacting the cavity walls, assumes a configuration that is substantially similar to the section-profile of the cavity, in such a way that, when the spring is released, the pressure-pads and the elastically deformable structures can exert their pressure on the lining against the walls in a more forcible manner, and substantially, in the direction perpendicular to the walls.

This is also due to the particular hinges between the various rods and between the pressure-rods and the pressure-pads or the elastically deformable structures, which adapt the frame to be disposed in the most appropriate way.

Finally, the distance beween the hinges and the bary-center of the rods upon which they are situated, can be varied in the planning phase to make each frame assume a configuration, when not contacting the walls, which is similar to the profile of the cavity, and consequently, which is better adapted for pressing the lining against the walls in each and every section of the cavity.

In this manner, the possibility of distributing in the best possible way the pressure exerted by the spring to press the lining against the walls is achieved with an identical pressure at every point where the contact takes place between the pressure-pads or the elastically deformable structures and the lining-layer.

Although the invention has been described in detail for the purpose of illustration, it is to be understood that such detail is solely for that purpose and that variations can be made therein by those skilled in the art except as limited by the claims.

For example, the elastically deformable members and in particular pressure pads 20 may be of an elastomeric material which resists the fluid contained in the lining or they may be metallic strips or rods for example of harmonic steel.

What is claimed is:

1. A device for maintaining a flexible liner in contact with the walls of an excavation in the earth comprising a plurality of frames spaced one from the other and disposed in planes which are substantially perpendicular to the larger dimension of the excavation, said frames comprising a double series of rods, means hinging the rods of each series together in a cascade-connection, means hinging the first rods of each series to each other at one end, and to the wall, an elastically deformable member hinged to the ends of the last rods of the series, and at least one rod intermediate said first and last rods hinged to the immediately preceding rod at a point intermediate of its length and hinged to the rod that follows in each series at its ends, and resilient means for drawing apart the double series of rods.

2. The device of claim 1, wherein each hinge is placed in an asymmetrical position with respect to the rod's bary-center.

3. The device of claim 1, wherein said elastically deformable elements are pressure-pads.

4. The device of claim 1, wherein said elastically deformable elements are H-shaped structures.

5. The device of claim 1, wherein said means for drawing apart the double series of rods are biasing means.

6. The device of claim 5 wherein said biasing means comprise a spring interposed between the said first rods of two series of rods.

7. The device of claim 1, wherein said means for drawing apart the double series of rods is a strut of variable length.

8. A skeleton supporting structure for a flexible sheet lining a wall of a cavity in the earth comprising on each of opposite sides of the cavity spaced flexible pads disposed against said sheet, and a series of rods connected together to form a support structure having axes which are substantially perpendicular to the axis of the cavity on opposite sides of the median line of the cavity, each series comprising a first rod pivotally secured to each of two adjacent flexible pads and spanning the space therebetween, a second rod pivotally secured at its ends to each of a pair of adjacent first rods, and a third rod pivotally secured at one end to a second rod and pivotally secured at its opposite end to said wall, and resilient means secured between said third rods on opposite sides of the cavity biasing the third rods apart thereby initiating a pressing force in the third rods which is transferred through the said second rods to the said first rods to press the pads against said sheet.

9. A skeleton supporting structure for a flexible sheet lining of a wall of a cavity in the earth comprising:

means securing a flexible hinge to the top of the cavity at a point intermediate the side walls of the cavity;

a first pair of rods of approximately equal length suspended by their upper ends from said hinge with spring means between said rods forcing them outwardly to form an inverted "V" formation, with one rod on each side of the center of said cavity;

a second pair of rods, each of which is pivotally secured, from a point intermediate its ends, to the lower ends of the first pair of rods;

third and fourth pairs of rods, each of which is pivotally secured, from a point intermediate its ends, to one of the ends of said second pair of rods;

a pressure pad secured to each end of each of said third and fourth rods, said pads contacting said sheet lining and pushing it outwardly from the center of said cavity to hold the lining against the walls of the cavity.

* * * * *